United States Patent [19]

Cronin

[11] 4,222,039

[45] Sep. 9, 1980

[54] MODULAR PANEL OF TUNGSTEN LIGHT SWITCHES WITH CURRENT LIMITING INDICATING, AND SWITCHING CAPABILITY

[75] Inventor: Michael J. Cronin, Sherman Oaks, Calif.

[73] Assignee: Lockheed Aircraft Corporation, Burbank, Calif.

[21] Appl. No.: 755,559

[22] Filed: Dec. 30, 1976

[51] Int. Cl.[2] ..... G08B 5/36; G08B 21/00

[52] U.S. Cl. ..... 340/381; 200/314; 200/317; 340/365 R; 340/642; 340/711

[58] Field of Search ..... 340/365 R, 337, 381, 340/378 MW, 324 OR, 253 B, 251, 324 B, 711, 715, 809, 808, 807, 806, 641, 642, 652; 200/313, 314, 317; 40/77.8, 68, 493, 501, 502, 514; 35/10, 13, 7 R; 116/129 G, 129 H, 129 T, 131, 279, 280, 286, 309

[56] References Cited

U.S. PATENT DOCUMENTS

| | | | |
|---|---|---|---|
| 1,999,781 | 4/1935 | Pinkler | 340/251 |
| 2,488,271 | 11/1949 | Curtis | 40/77.8 |
| 3,200,375 | 8/1965 | Lutz | 340/365 R |
| 3,307,174 | 2/1967 | Klukowski | 340/365 S |
| 3,522,600 | 8/1970 | Amis et al. | 340/381 |
| 3,688,414 | 9/1972 | Koehlinger et al. | 35/13 |
| 3,706,983 | 12/1972 | Olson et al. | 340/253 B |
| 3,737,898 | 6/1973 | Cross | 340/381 |
| 3,778,820 | 12/1973 | Van Benschoten et al. | 340/381 |

FOREIGN PATENT DOCUMENTS

| | | | |
|---|---|---|---|
| 0568700 | 4/1945 | United Kingdom | 116/131 |

OTHER PUBLICATIONS

Westinghouse Electric Co. Publication, May 1923, p. 403, "Lamp Indicators,"

*Primary Examiner*—John W. Caldwell, Sr.
*Assistant Examiner*—James J. Groody
*Attorney, Agent, or Firm*—Lowell G. Turner

[57] ABSTRACT

A modular panel of dual filament tungsten lamp switches with current limiting, fault indicating, continuous lamp filament testing, and remote control switching capabilities.

In one embodiment, the dual filament, self monitoring tungsten lamps are mounted as switches in an array and identified by row and column, the panel including a drum assembly rotatable to a related one of the rows and carrying indicia indicative of the circuits associated with the lamp in each column in the selected row.

In a second embodiment, the dual filament, self-monitoring lamps are mounted as switches in an array. Each lamp or the lens cover associated therewith includes circuit identifying indicia visible in daylight by normal contrast and illuminated sufficiently by the lamps for visibility in a dark adapted environment such as the cockpit of an aircraft at night.

16 Claims, 6 Drawing Figures

MODULAR PANEL OF TUNGSTEN LIGHT SWITCHES WITH CURRENT LIMITING INDICATING, AND SWITCHING CAPABILITY

BACKGROUND OF THE INVENTION

The present invention is related to a circuit breaker panel and more particularly to a circuit breaker panel for an aircraft or other environment where volume, weight, and wiring complexity are considerations, and where fault indications, redundancy, continuous monitoring of the lamp filaments and current limiting are desired.

Circuit breaker panels such as those found, for example, in the flight station of a modern aircraft, have generally included an array of rather large and heavy circuit breakers of the electromechanical or magnetic type. Because of the circuits controlled by these circuit breakers, each circuit breaker is generally individually wired by hand and presenting a virtual rats' nest of wiring. In addition to the physical space required for the circuit breakers themselves and the space needed to implement the wiring connections, conventional circuit breaker panels carry the indicia associated with each switch in immediate proximity thereto.

It is accordingly an object of the present invention to reduce many of the space requirements of the prior art circuit breaker panels and to provide a panel of considerably reduced size and wieght.

Identification of the circuits associated with each of the circuit breakers in the prior art panels is generally accomplished by etching of the surface of the panel in proximity to each of the circuit breakers. This permits the use of the technique of edge lighting to provide the necessary illumination of the identifying indicia when there is little or no ambient light such as the cockpit of an aircraft when dark adapted. This technique has the disadvantage of necessitating replacement of the entire etched panel in the event of a single circuit change.

It is accordingly an object of the present invention to obviate the identifying problems of many prior art circuit breaker panels and to provide a novel panel in which the identifying indidial is visible in daylight, illuminated from the rear sufficiently for visibility in the absence of ambient light, and individually associated with each circuit breaker for ease of replacement as well as to provide the control/reset functions of a conventional circuit breaker panel.

A further problem in prior art circuit breaker panels has been one of indicating the status of the circuit. Where lamps have been provided for this purpose, additional space is required on the panel. In addition, the testing of the lamps for failure becomes a problem generally resolved only by the push-to-test method. This method, of course, provides an indication of lamp status only at the time of the test and provides no redundancy in the event of the failure of the lamp filament.

It is accordingly an object of the present invention to obviate many of the deficiencies of the prior art circuit breaker panels and to provide a novel panel which features redundancy in circuit status indication, continuous testing of the indicator lamps, and association of the identifying indicia directly on the circuit breaker.

An additional problem in prior art circuit breaker panels has been the handling of excessive fault current. Reactances have been used for a.c. applications but are not adaptive for d.c. circuits. Solid state devices of the semi-conductor type are, on the other hand, suitable only for d.c. circuits unless connected in a back-to-back mode and are often highly responsive to temperature and voltage transient.

It is accordingly an object of the present invention to provide a novel and inexpensive circuit breaker panel having a current limiting capability for a.c. or d.c. power circuits as well as status indicating, trip, and reset means.

These and many other objects and advantages of the present invention could be apparent from the claims and from the following detailed description when read in conjunction with the appended drawings.

THE DRAWINGS

Figure 1:
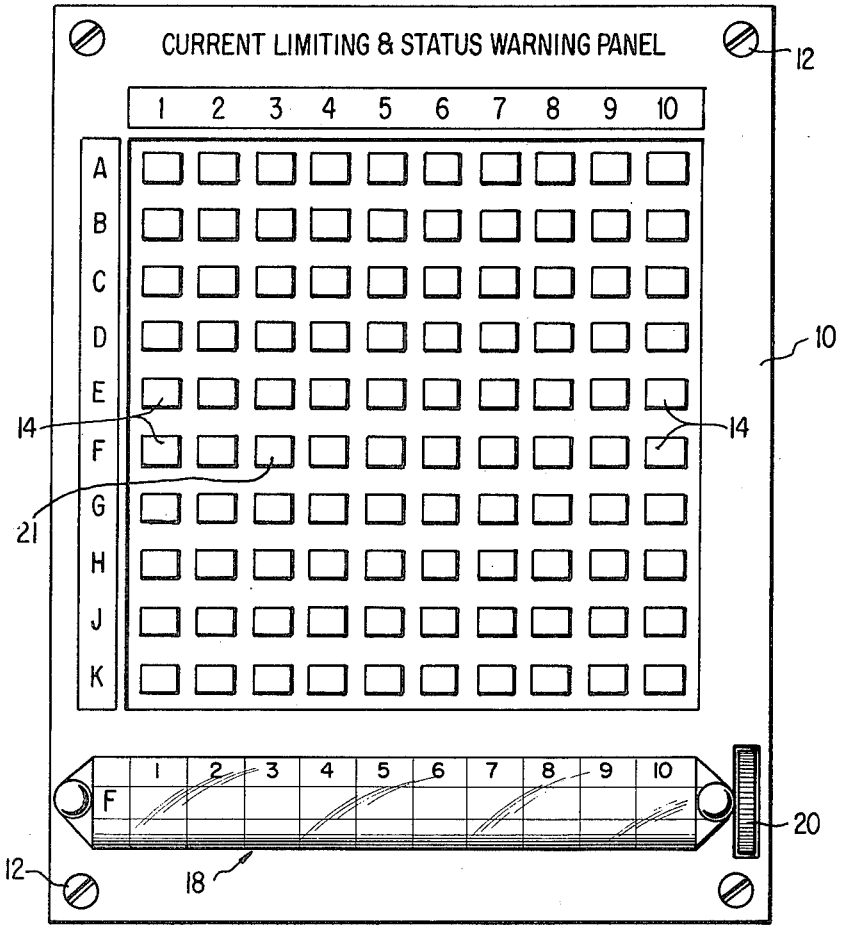
FIG. 1 is an elevation of the front of a first embodimeent of the circuit breaker panel of the present invention.
Figure 2:
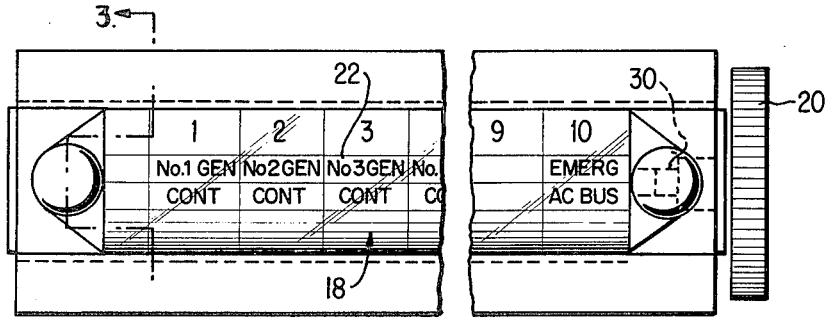
FIG. 2 is an enlarged view of the circuit breaker identifying drum assembly of the panel of FIG. 1.
Figure 3:
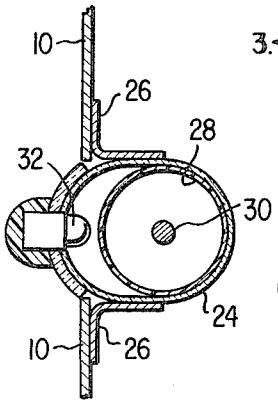
FIG. 3 is a section taken through lines 3—3 of the drum assembly of FIG. 2.

With reference to the embodiment illustrated in FIGS. 1, 2 and 3, the numerical designations have been utilized for like elements to facilitate an understanding of the panel. The panel 10 may be mounted in any suitable conventional manner such as the illustrated threaded fastener 12 to a bulkhead or overhead structure of the flight station of an aircraft.

The panel 10 is provided with an array of current limiting warning lamp switches (CLWL-SW's) of the type disclosed in the co-pending application Ser. No. 755,558, now U.S. Pat. No. 4,104,620, entitled "Dual Filament Current Limiting and Status Inducting Circuit" and filed concurrently herewith, the disclosure of said co-pending application being hereby incorporated herein by reference.

Figure 6:
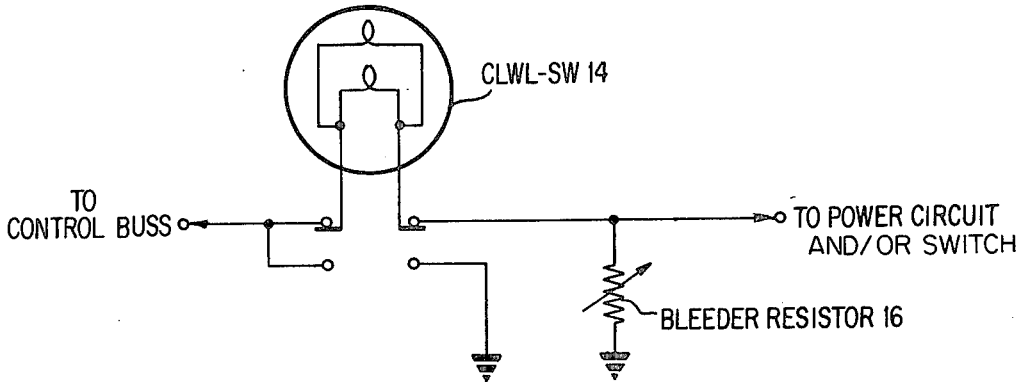

Each of these CLWL-SW's 14 may be of the dual tungsten filament type disclosed in said co-pending application and may be provided with a bleeder resistor 16 as shown in FIG. 6 to insure current flow through both filaments of the CLWL-SW during normal operation. The nature of the bleeder resistor 16 is desirably selected with reference to the CLWL-SW so that the current through both filaments is insufficient to effect visible incandescence of the lamps. Should, however, one of the filaments fail, the passage of all of the bleeder resistor current through the remaining filament will be sufficient to effect a dim but visible incandescence of the lamp. A continuous self monitoring of the status of the filaments of the CLWL-SW is thus effected.

In the event of a fault in the associated power circuit (not shown) and/or the operation of the switch in the power circuit, the level of current through the CLWL-SW will be sufficient through either one or two filaments to effect an incandescence visible even in daylight to thus indicate the existence of the fault and/or the operation of the switch in the power circuit.

Current limiting is provided by CLWL-SW due to the nonlinear impedance characteristics thereof. The continuous heating of the filaments by the the current through the bleeder resistor reduces the vulnerability of the lamp to the shock of current surges and mechanical vibration and the dual filaments provide the desired redundancy.

With reference again to FIGS. 1, 2 and 3, the CLWL-SW's 14 are desirably arranged in rows designated in FIG. 1 with letters of the alphabet, i.e. A, B, C, D, etc., and in columns designated in FIG. 1 with numerals, i.e. 1, 2, 3, 4, etc. At the bottom of the CLWL-SW array is provided a drum assembly 18 which extends across the full width of the panel and which is manually rotatable about its longitudinal axis by means of a thumb wheel 20 to present in alignment with the columns of CLWL-SW's 14 certain identifying indicia.

In operation, the illumination of a CLWL-SW in the position 21 identified in FIG. 1 as the F row and 3 column can be identified by the manual rotation of the drum assembly 18 to display the identifying indicia associated with the row F, the identifying indicia 22 in position under the third column being that of the particular CLWL-SW illuminated.

The construction of the current limiting and status warning panel of the present invention is shown in more detail in FIGS. 2 and 3. The matrix of CLWL-SW's 14 illustrated in FIG. 1 is visible from the front of panel by extending the CLWL-SW through an opening therein. Each of the CLWL-SW's 14 may be connected in the control circuit for a particular load device as illustrated, for example, in the co-pending application Ser. No. 755,557, now U.S. Pat. No. 4,143,410, entitled "Electric Power System Control Utilizing Low Voltage Signals and Minature Gauge Wiring" and hereby incorporated herein by reference.

The rotatable drum assembly 18 may include, as illustrated in FIGS. 2 and 3, a generally tubular housing member 24 secured to the panel by support members 26 so as to extend partially through a horizontal slot in the panel 10. Supported internally of the housing member 24 is a drum 28 mounted on a shaft 30 for rotation by the manual rotation of the thumb wheel 20 from the front of the panel 10 the tubular member 24 may be apertured in the rear portion thereof to receive a light source such as the illustrated incandescent lamp 32 mounted by any suitable conventional means to the tubular member 24 and/or the panel 10.

The drum 28 is provided around its periphery in the illustrated embodiment with ten horizontal rows of spaces, each of the ten rows being identified at the extreme left by one of the letters A through K and having ten spaces in substantially vertical alignment with the columns 1 through 10 of the panel 10. The tubular housing member 24 is desirably transparent, at least in the extreme forward portion thereof, so that the identifying indicia on the drums 28 is selectively viewable in accordance with the rotary position of the drum 28. The lamps 32 provided at each end of the housing member 24 illuminate the indicia on the selected row of the drum 28.

Figure 4:
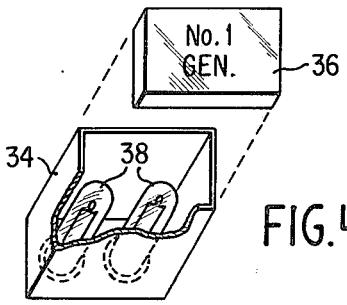
FIG. 4 is a pictorial view of one of the indicator lamp switches of the panel of FIG. 1; portions being cut away and the lens cover being removed to illustrate the use of dual lamps.

Each of the CLWL-SW's 14 of the panel of FIG. 1 may be of the type illustrated in FIG. 4 where the CLWL-SW includes a push button 34 of generally rectangular cross-section and having a cap or lens cover 36 removably attached thereto. The indicia illustrated on the cap 36 in FIG. 4 is not needed in the embodiment of FIG. 1 but is desirable in the embodiment of FIG. 5 hereinafter to be described.

With continued reference to FIG. 4, each of the push buttons 34 may carry a pair of single tungsten filament incandescent lamps 38 connected in parallel between the source and a bleeder resistor as shown in the circuit illustrated in FIG. 6. The two single filament lamps 38 may be replaced by a single dual filament lamp and additional filaments may be utilized to increase redundancy if desired.

Figure 5:
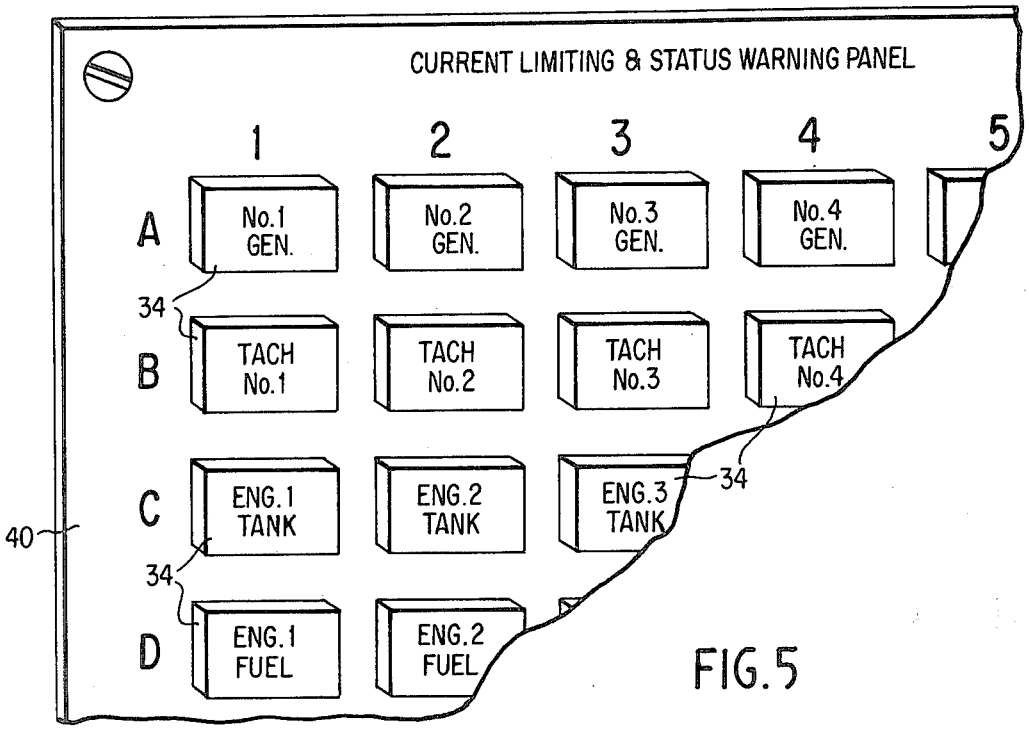
FIG. 5 is an elevation of a front of a second embodiment of the circuit breaker panel of the present invention; and, FIG. 6 is a schematic circuit diagram of a CLWL-SW such as employed in the panels of FIGS. 1 and 5.

CLWL-SW's 14 like those illustrated in FIG. 4 have particular utility in the embodiment of the present invention illustrated in FIG. 5. With reference to FIG. 5, a current limiting and status indicating panel 40 is provided with a matrix of apertures aligned in rows designated with letters of the alphabet, i.e. A, B, C, D, etc., and in columns designated with numerals, i.e. 1, 2, 3, 4, etc. The rotating drum assembly of the embodiment of FIG. 1 has been omitted since each of the push buttons 34 carries its own identifying indicia.

The indicia on each of the push buttons 34 is designed to be visible in daylight and may, for example, be black upon a pale yellow or pink background. In a dark adapted cockpit, the indicia will be visible as a result of the small current flowing through the lamp filaments and the bleeder resistor. The level of illumination may be adjusted by adjusting the value of the resistor 16 in the circuit of FIG. 6 to a visible level not destructive of night vision.

In the event of the failure of one of the two lamp filaments, the level of illumination will increase as all of the current through the bleeder resistor passes through the single remaining filament to a dim but noticeable level well below the level of illumination indicative of switch position.

By the use of a panel such as that illustrated in FIG. 5, the number of indicator lamps was increased in one of the overhead circuit breaker panels of an aircraft from 90 to 160. The use of a printed circuit board was made possible by the current limiting feature of the lamps as a result of the decreased values of fault current in the control circuits. The rats' nest of individually hand wired connector cables on the rear of the panel was also obviated by the reduction in current and symmetry of design.

The present invention has been described in conjunction with specific embodiments, various modifications and variations of these described forms of the invention will be apparent to persons of ordinary skill in the art. It is intended, therefore, that the foregoing detailed description of the invention as illustrated in the drawings be considered as exemplary only and that the scope of the invention be determined from the following claims when accorded a full range of equivalents.

What is claimed is:

1. A current limiting and status indicating panel comprising:

a substantially planar panel member having a matrix of apertures arranged in rows and columns; and a printed circuit board having a plurality of indicator-switches arranged in rows and columns corresponding to the rows and columns of the apertures in said panel member and disposed rearwardly of said panel member with a portion of each of said plurality of indicator-switches protruding forwardly through said plurality of apertures for manual operation from the front of said panel member, each of said plurality of indicator switches comprising a plurality of tungsten lamp filaments connected in parallel, an impedance element for providing a continuous current path through said lamp filaments, and a surface carrying circuit identifying indicia, the current through said lamp filaments being sufficient to visibly illuminate said indicia in the absence of ambient light without destroying the night vision of the viewer and being insufficient to illuminate said indicia in the presence of significant ambient light.

2. The current limiting and status indicating panel of claim 1 wherein said plurality of tungsten lamp filaments includes a single lamp having a plurality of filaments.

3. The current limiting and status indicating panel of claim 1 wherein said plurality of tungsten lamp filaments includes a plurality of single filament lamps.

4. The current limiting and status indicating panel of claim 1 wherein the value of said impedance element is such that the failure of one of said plurality of filaments will increase the current through the remaining ones of said plurality of filaments sufficiently to effect a dim but noticeable incandescence of said indicator-switch, said level of incandescence being greater than that required for illumination of said indicia in the absence of ambient light and significantly less than full brightness of said indicator-switch.

5. The current limiting and status indicating panel of claim 1 wherein said impedance element is selectively adjustable to selectively vary the level of illumination of said indicator-switches.

6. The current limiting and status indicating panel of claim 1 wherein said circuit-identifying indicia carrying surface is selectively removable from said indicator-switch to permit the replacement of said plurality of filaments from the front of said panel member.

7. A current limiting and status indicating panel comprising:

a substantially planar panel member having a plurality of apertures arranged in rows and columns and carrying row and column identifying indicia;

a printed circuit board carrying a plurality of indicator-switches arranged in rows and columns corresponding to the rows and columns of the apertures in said panel member and disposed on one side of said panel member with a portion of said indicator-switches extending through said apertures in said panel member for manual operation from said other side of said panel member;

means supported by said panel and spaced apart from, but in alignment with, said rows and columns and carrying circuit identifying data in rows and columns corresponding to the rows and columns of said panel member; and, means drivingly connected to said data carrying means for selectively positioning said data carrying means to display a row of said circuit identifying data in alignment with the columns, each of said indicator-switches including a plurality of tungsten filaments and a series impedance element for providing a continuous current path through said plurality of filaments to permit selective energization of said plurality of filaments.

8. The current limiting and status indicating panel of claim 7 wherein said data carrying means includes a drum member rotatably mounted on said panel member; and, wherein said selective positioning means includes a thumb wheel drivingly connected to said drum member for selectively rotating said drum member about the longitudinal axis thereof.

9. The current limiting and status indicating panel of claim 8 including means, disposed on said one side of said panel member, for illuminating the displayed row of the circuit identifying indicia carried by said drum member.

10. The current limiting and status indicating panel of claim 7 wherein said plurality of tunsten lamp filaments includes a single lamp having a plurality of filaments.

11. The current limiting and status indicating panel of claim 7 wherein said plurality of tungsten lamp filaments includes a plurality of single filament lamps.

12. The current limiting and status indicating panel of claim 7 wherein the value of said series impedance element is such that the failure of one of said plurality of filaments of a given one of said indicator-switches, will increase the current through the remaining one of said plurality of filaments of said given indicator-switch sufficiently to effect a dim but noticeable incandescence of said given indicator-switch, said level of incandescence being greater than that required for illumination of said indicia in the absence of ambient light and significantly less than full brightness of said indicator-switch.

13. The current limiting and status indicating panel of claim 7 wherein said impedance element is selectively adjustable to selectively vary the level of illumination of said indicator switches.

14. A modular panel comprising:

a supporting panel; and, a plurality of indicator-switches carried by said supporting panel, each of said indicator-switches including:

a bleed impedance, a plurality of non-linear impedance means connected in parallel for providing alternative current paths through said bleed impedance, and a pair of switch contacts in series with said non-linear impedance means and in parallel with said bleed impedance, at least one of said non-linear impedance means being disposed to visually indicate the status of said switch contacts.

15. A signal lamp display device comprising:

a planar panel supporting a matrix of two lines of signal lamps disposed in two substantially perpendicular directions and parallel with the plane of said panel;

means on said panel providing a display area which extends in one of said perpendicular directions and which corresponds in length to the length of the line of lamps in said one direction;

identification means adapted to be selectively disposed into said display area and providing a matrix of a plurality of spaces for identifying data for said lamps, said spaces being arranged in the same relative relationship as said lamps in the other of said directions; and, means for selectively positioning said identification means to display a line of said identifying data extending in said one direction into said display area.

16. A signal lamp display device as recited in claim 15 wherein said means for selectively positioning said identification means includes a roller rotatably mounted on said panel and on which said identifying data is disposed.

* * * * *